US006193174B1

(12) United States Patent
Staples et al.

(10) Patent No.: US 6,193,174 B1
(45) Date of Patent: Feb. 27, 2001

(54) AIR HANDLING SYSTEM FOR AN ADVANCED WEB FORMER

(75) Inventors: Phillip Osborne Staples, Nashville; Kenneth Stephen Freund, Gallatin; Andrew James Giles, Joelton, all of TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/337,784

(22) Filed: Jun. 22, 1999

Related U.S. Application Data

(60) Provisional application No. 60/091,262, filed on Jun. 30, 1998.

(51) Int. Cl.[7] ..... B05B 1/14
(52) U.S. Cl. ..... 239/590
(58) Field of Search ..... 239/589, 590, 239/590.5, 592; 19/296, 304; 138/37, 39, 40

(56) References Cited

U.S. PATENT DOCUMENTS

| | | | | |
|---|---|---|---|---|
| 2,056,782 | | 10/1936 | Fosdick | 138/39 |
| 3,797,074 | | 3/1974 | Zafiroglu | 19/306 |
| 3,834,869 | * | 9/1974 | Ancelle et al. | 19/304 X |
| 3,856,281 | * | 12/1974 | Bertolotti et al. | 239/590 X |
| 3,914,822 | | 10/1975 | Wood | 19/156.3 |
| 3,932,915 | | 1/1976 | Contractor et al. | 19/156.3 |
| 3,996,978 | | 12/1976 | Rupaelian | 19/156.3 |
| 4,057,487 | | 11/1977 | Skrabak et al. | 210/65 |
| 4,186,463 | * | 2/1980 | Marshall | 19/304 |
| 5,439,358 | | 8/1995 | Weinbrecht | 418/15 |
| 5,537,718 | * | 7/1996 | Nagatsuka et al. | 19/296 X |
| 5,564,630 | | 10/1996 | Giles et al. | 239/8 |
| 5,722,830 | | 3/1998 | Brandhorst et al. | 433/90 |

FOREIGN PATENT DOCUMENTS

| | | | |
|---|---|---|---|
| 9321 075 U1 | 2/1992 | (DE) | B05B/1/02 |
| 568 748 A1 | 4/1992 | (EP) | F02C/3/045 |
| 667 460 A2 | 1/1995 | (EP) | F15D/1/04 |
| WO 97/22743 | 6/1997 | (WO) . | |

* cited by examiner

*Primary Examiner*—Andres Kashnikow
*Assistant Examiner*—Davis Hwu

(57) ABSTRACT

An apparatus for distributing fiber from a carding machine to an airlay wherein the apparatus comprises a system of ducts or conduits for controlling air flow having a curved top wall and a curved bottom wall that define a converging passageway and the distance between the walls is defined by an exponential equation.

10 Claims, 3 Drawing Sheets

AIR HANDLING SYSTEM FOR AN ADVANCED WEB FORMER

This application claims priority upon provisional application No. 60/091262, filed Jun. 30, 1998.

FIELD OF THE INVENTION

This invention relates to airlay fiber handling equipment such as an airlay web former and more particularly to controlling the air stream into the web former.

BACKGROUND OF THE INVENTION

In the airlay web forming process in use by E.I. du Pont de Nemours and Company (DuPont) in the manufacture of spunlaced fabrics sold under the trademark Sontara®, fiber is carried by a relatively fast-moving air stream to a screen conveyor forming a web of randomly arranged fibers. The commercial process is disclosed and described in U.S. Pat. No. 3,797,074 to Zafiroglu.

Upon investigation, it has been hypothesized that the air flow which carries the fiber to the screen conveyor is subject to eddies, vortices and other indicators of turbulence at the peripheral sides of the web which is undesirable. In accordance with Zafiroglu, the air that is used to carry the fiber is introduced through a system of large conduits and fans. Prior to receiving the fiber, the air flow is directed through screens and straighteners to provide a uniform flow substantially free of large-scale turbulence and vortices. Thereafter, the large volume, relatively slow-moving air flow is accelerated through a converging section or nozzle into a reduced cross sectional area conduit which is substantially flat and wide to be suited for laying down a wide web. It is believed that the acceleration nozzle of Zafiroglu creates, or allows the creation of the vortices and turbulence at the peripheral sides of the web which is believed responsible for certain defects.

U.S. Pat. 5,564,630 to Giles et al (assigned to DuPont) is directed to an improved nozzle over that of Zafiroglu by providing smoothly curving, low angle peripheral walls. The nozzle is particularly helpful in reducing edge defects which can result from vortices and turbulence. Regardless, considerable need remains for improvement of web properties.

U.S. patent application Ser. No. 08/760,119 now abandoned (also assigned to DuPont) is directed to combining the advantages of feeding carded fibers to an airlay. The air stream in that patent application is controlled by use of fans and a series of filters and air straighteners to create a laminar air flow. However, such an arrangement may present disadvantages in terms of space requirements and by making the maintenance of the cards especially difficult.

SUMMARY OF THE INVENTION

Accordingly, it is an object of the present invention to provide means for controlling the air stream into an airlay web former arrangement which substantially reduces the defects of the web and overcomes the drawbacks of existent arrangements as described above.

These objects of the invention are accomplished by a device for directing air flow comprising a first conduit with an inlet and an outlet and having an upper curved wall surface and a lower curved wall surface wherein the bottom curved wall surface has a greater degree of curvature than does the upper curved wall surface so that the distance between the curved wall surfaces generally decreases and thereby substantially changes the direction of air flow from the inlet to the outlet. These objects of the invention are further accomplished by a device comprising the first conduit and a second conduit of similar configuration to the first conduit and wherein the first conduit and second conduit combine at their outlet areas to form a third single conduit.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale. The drawings are briefly described as follows.

DETAILED DESCRIPTION OF THE PREFERRED EMBODIMENT

Figure 1:
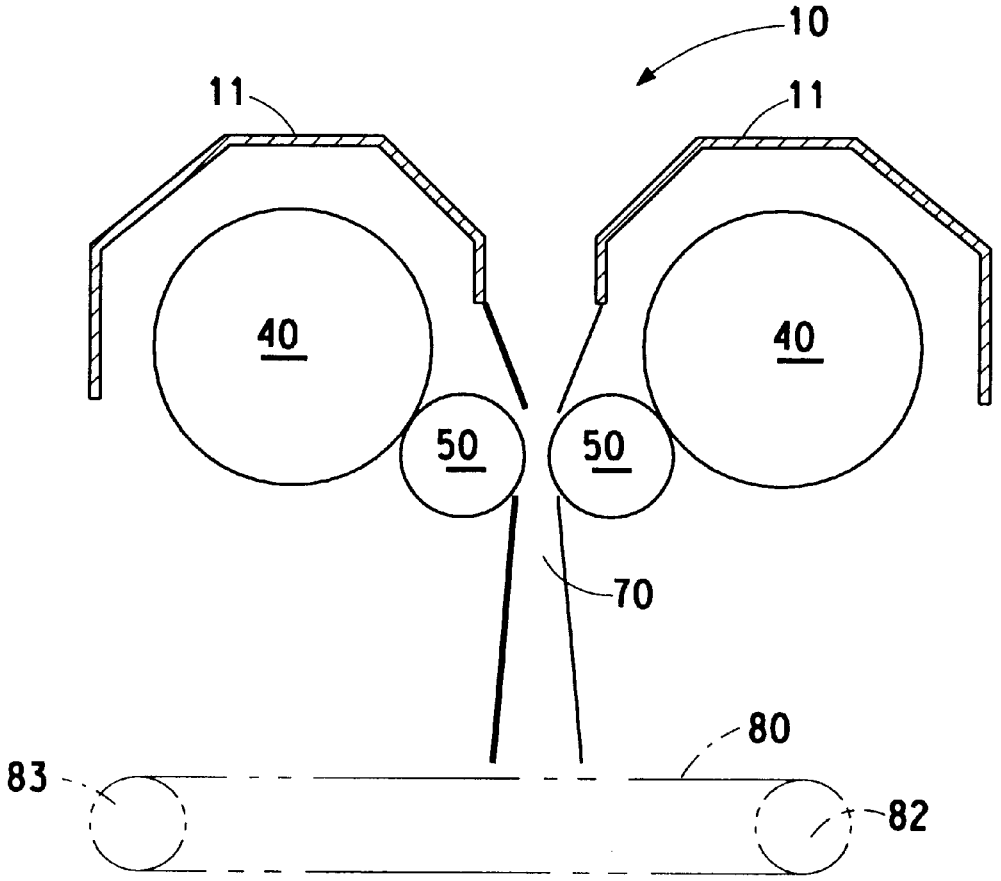
FIG. 1 is a generally schematic view of an existent device in which a carding machine feeds fiber to an airlay.

Referring now to the drawings, the invention will be described in greater detail so as to explain the contribution to the art and its application in the industry. Referring specifically to FIG. 1, the fiber handling system of an existing embodiment is generally referred to by the number 10 and may be more easily understood as having an airlay portion generally indicated by disperser rolls 50 and an air duct 70 and a carding machine portion generally indicated by main carding rolls 40. The existing embodiment transports fiber through the carding machine portion and then through the airlay portion. It is well known that cards typically have worker and/or stripper rolls associated with the main carding roll as well as other secondary carding rolls. However, for the sake of simplicity such detail is omitted here.

Referring again to FIG. 1, the disperser roll 50 carries the fiber from the main carding roll 40 to an air duct 70. In the air duct 70, an air stream is made to pass over the surface of the disperser roll 50 in a generally tangential relationship to receive the fiber being doffed from the disperser roll 50. The fiber is quite likely to doff from the disperser roll 50 without the presence of the air stream creating a cloud of individualized fiber; however, it is preferred to provide the individualized fiber into an air stream where it may be more easily handled. It is preferred that the air stream be generally free of turbulence so as to allow the fiber to be dispersed throughout the air stream. Eddies, vortices and other turbulence tend to disturb the distribution of the fiber in the air duct 70 which causes undesirable consequences depending on the use that will be made with the fiber in the air stream. The webs produced under such conditions typically exhibit splotchiness and non-uniformities caused by the fiber following the path of the vortices and eddies and not laying down properly.

The fiber can be laid onto a web on a screen conveyor belt 80 at the base of the air duct 70. The screen conveyor belt 80 is carried by a series of rollers including rollers 82 and 83. Below the screen conveyor 80 a vacuum duct (not shown) can be positioned to pull air in the air duct 70 down through the screen conveyor belt 80 to pin the fiber thereon and remove it from the system.

As shown in FIG. 1, the cards may be generally enclosed by card covers 11 and the airstream is drawn from the atmosphere around the covers. Here a system is depicted where two separate card systems feed fiber into a common air duct 70. Air is drawn into the air duct 70 by the action of the doffing rolls 50, but such air does not behave in a uniform manner. Because the atmospheric air is not controlled in any fashion, the air does not easily form into a uniform, laminar air stream. By placing a grid over the web former and attaching strings to the grid it was found that during operation of the web former that the strings exhibited violent, random movements indicative of turbulent air flow. Further, a videotape was made of the fibers as they were subjected to the turbulence and the video showed that the fibers moved back and forth across the web area which would cause undesirable streaks.

Figure 2:
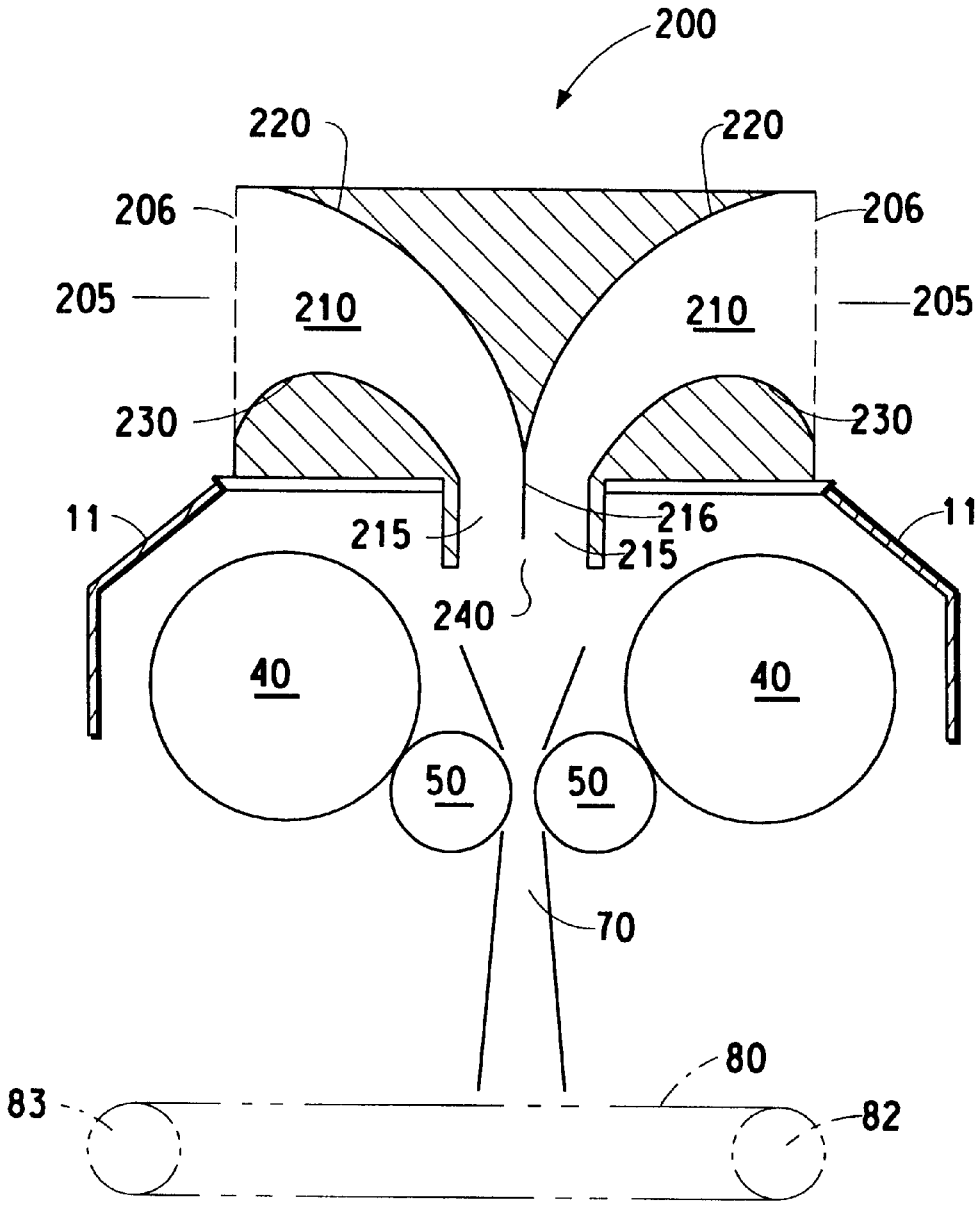
FIG. 2 is a view similar to FIG. 1 showing the air controlling device of the invention.

In view of the need to control the air going into the air duct 70 and to address some of the physical limitations that are associated with the area around the cards that would prevent control of the air, the subject invention was developed. As depicted in FIG. 2 an air controlling device 200 was developed. The device 200 is depicted as comprising two identical passages 210 that transport air and would typically change the air flow from a substantially horizontal direction to a substantially vertical direction. It should be noted however that the air flow is to be controlled so as to achieve a laminar flow without any indicator of turbulence and is not limited to changing the air flow from vertical to horizontal or some other change in orientation. Each passageway is defined by an outer upper surface 220 and an inner lower surface 230. Both surfaces have a curvature such that the distance between them decreases in the direction of the air flow. Although the system is described in terms of two passageways, it should be understood that either a single passage or a plurality of passages can be used consistent with the desired throughput to the airlay and amount of control of the air stream.

The air enters the device 200 at a relatively large inlet 205 and where a vertical screen 206 is located which provides a pressure drop to slow and to straighten the incoming air. The screen is oriented in a generally vertical direction because a horizontal screen would collect stray fiber and debris which could cause defects in the web. Even using a vertical screen it is desirable that the air enters screen 206 at a relatively low speed because at high speeds airborne particles and debris may collect on the screen even with the vertical orientation. Typically, it is preferred that the air stream speed at the screen be less than about 2 meters per second. The air proceeds through passage 210 and exits at a small end outlet 215 (small relative to inlet 205).

In one embodiment the device 200 is adapted to fit onto the top and between an existing pair of cards by replacing all or part of the card covers 11 as generally depicted in FIG. 2. Instead of air entering the air duct 70 in a random fashion, the device 200 provides a specifically curved path that causes two separate air streams from two ducts 210 to join and form one airstream in a single duct 240 having a controlled laminar flow. By laminar, it is meant that the air stream substantially travels uniformly in one direction without any eddies, vortices or other indicators of turbulence. To further ensure that that the air flow becomes laminar an extension wall 216 may be added at the juncture of the upper curved surfaces 220.

Figure 3:
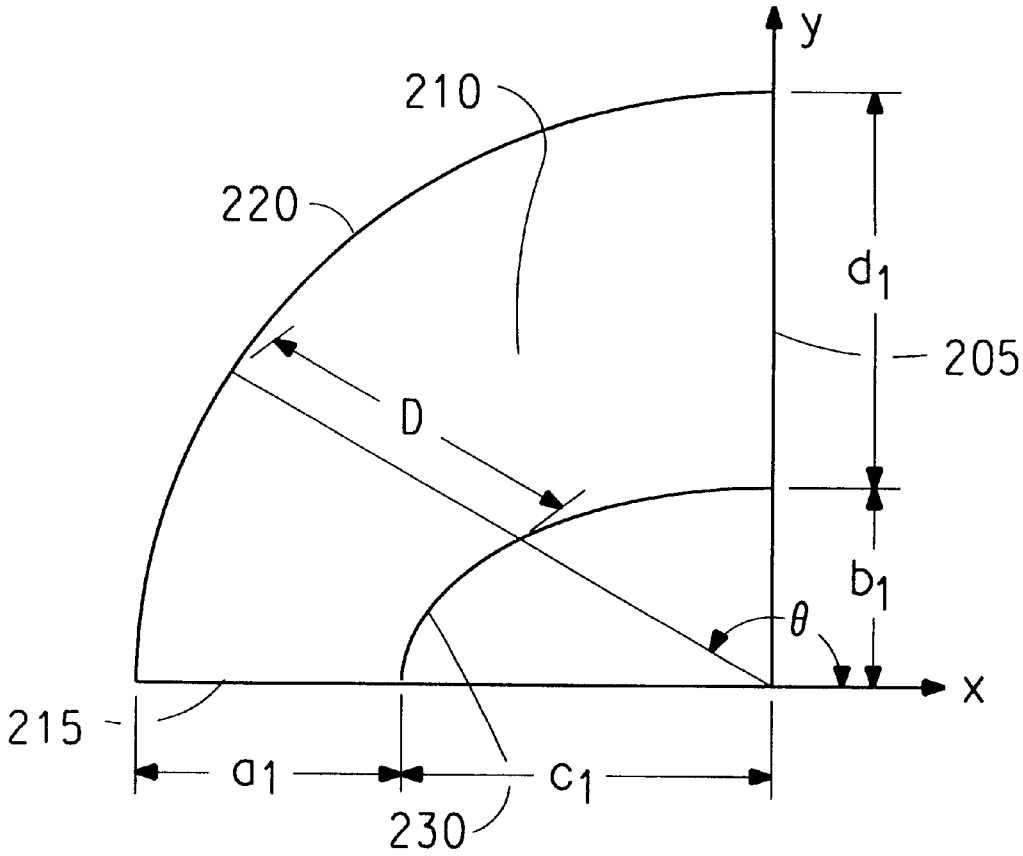
FIG. 3 is a representation of a portion of the device shown in FIG. 2 superimposed on Cartesian coordinates.

In FIG. 3 the dimension $d_1$ of the large end inlet 205 is shown as superimposed on a y-axis and the dimension $a_1$ of the small end outlet 215 is shown superimposed on an x-axis. The distance D is shown as the distance between upper curved surface 220 and lower curved surface 230 as a function of angle θ. It can be generally stated that the curvature of the upper surface 220, the curvature of the lower surface 230 and the distance D between the curved surfaces can be expressed by the following mathematical equations:

Upper Curved Surface $$x = (a_1 + c_1)\cos\theta$$
$$y = (b_1 + d_1)\sin\theta$$
$$\text{where } \frac{\pi}{2} \le \theta < \pi$$

Lower Curved Surface $$x = \left[c_1 - \frac{4(d_1 - a_1)}{\pi^2}(\theta - \pi)^2\right]\cos\theta$$
$$y = \left[b_1 + d_1 - a_1 - \frac{4(d_1 - a_1)}{\pi^2}(\theta - \pi)^2\right]\sin\theta$$
$$\text{where } \frac{\pi}{2} \le \theta < \pi$$

$$D = \frac{4(d_1 - a_1)}{\pi^2}(\theta - \pi)^2 + a_1$$
$$\text{where } \frac{\pi}{2} \le \theta \le \pi$$

The distance D is expressed by the exponential equation above at a power of two, but D could also be expressed by a cubic equation or any other equation that would provide the desired laminar flow to the air transported through the device. The equation for the upper curved surface as presented above defines an ellipse and was chosen primarily because of ease of formation in manufacture. However, the upper curved surface can be expressed by any twice continuously differentiable surface that is concave down.

The device's ability to distribute air as desired was evaluated by use of modeling software available from Fluent Inc. (Lebanon, NH). It was found from the modeling software that the curved surfaces of the subject invention provided laminar flow with virtually no formation of eddies and vortices. Such a condition would be expected to provide uniform webs.

What is claimed is:

1. A device for directing flow of a fluid comprising a first conduit with an inlet and an outlet and having an upper curved wall surface and an opposite lower curved wall surface wherein the lower curved wall surface is curved to a larger extent than is the upper curved wall surface such that the distance between the curved wall surfaces generally decreases in the direction of the flow from the inlet to the outlet at an exponential rate and thereby substantially changes the direction of the fluid flow from the inlet to the outlet.

2. The device of claim 1, further comprising a second conduit of similar configuration to the first conduit and wherein the first conduit and second conduit combine at their outlet areas to form a third single conduit.

3. The device of claim 1 or 2, wherein the exponential rate is expressed as a power of 2.

4. The device of claim 1 or 2, wherein the exponential rate is expressed as a power of 3.

5. In an apparatus for forming a web in an airlay, a device for directing air flow comprising a first conduit with an inlet and an outlet and having an upper curved wall surface and a lower curved wall surface wherein the lower curved wall surface has a greater degree of curvature than does the upper curved wall surface so that the distance between the curved wall surfaces generally decreases in the direction of the flow from the inlet to the outlet at an exponential rate and thereby substantially changes the direction of air flow from the inlet to the outlet.

6. The device of claim 5, further comprising a second conduit of similar configuration to the first conduit, wherein the first conduit and the second conduit combine at their outlet areas to form a third single conduit.

7. The device of claim 5 or 6, wherein the exponential rate is expressed as a power of 2.

8. The device of claim 5 or 6, wherein the exponential rate is expressed as a power of 3.

9. The device of claim 5 or 6 wherein the direction of the airflow is changed from essentially horizontal at the inlet to essentially vertical at the outlet.

10. The device of claim 9, wherein a substantially vertical screen is located at the inlet.

* * * * *